US006322074B1

(12) United States Patent
Forrest et al.

(10) Patent No.: US 6,322,074 B1
(45) Date of Patent: Nov. 27, 2001

(54) INTERACTIVE QUIZ GAME SYSTEM AND METHOD

(75) Inventors: Andrew R. Forrest, Everett; Alan J. Pruzan, Seattle; Shawn A. Belyea, Seattle; Michael R. Adams, Seattle; Peter G. Sarrett, Seattle, all of WA (US)

(73) Assignee: Forrest-Pruzan Creative LLC, Seattle, WA (US)

( * ) Notice: Subject to any disclaimer, the term of this patent is extended or adjusted under 35 U.S.C. 154(b) by 0 days.

(21) Appl. No.: 09/437,344

(22) Filed: Nov. 9, 1999

(51) Int. Cl.[7] ..... A63F 9/18; A63F 9/24

(52) U.S. Cl. ..... 273/272; 273/275; 273/430; 434/322

(58) Field of Search ..... 273/237, 271, 273/272, 275, 284, 287, 153 S, 430–432, 441, 240; 463/9, 115; 434/128

(56) References Cited

U.S. PATENT DOCUMENTS

| | | | | |
|---|---|---|---|---|
| 4,376,538 | * | 3/1983 | Keehan | 273/275 |
| 4,850,595 | * | 7/1989 | Sherman et al. | 273/240 |
| 5,312,112 | * | 5/1994 | Cohen | 273/272 |
| 5,324,040 | * | 6/1994 | Panda | 273/272 |
| 5,603,504 | * | 2/1997 | Powell | 273/348.4 |
| 5,679,075 | | 10/1997 | Forrest et al. . | |
| 5,853,327 | * | 12/1998 | Gilboa | 463/39 |

FOREIGN PATENT DOCUMENTS

2182572-A * 5/1987 (GB) .

OTHER PUBLICATIONS

Boggle by Parker Brothers http://ww.amazon.com/exec/obidos/ASIN/B00000IWCZ/qid=98 . . . /107–5785330–610454, pp. 1–5 http://ww.amazon.com/exec/obidos/tg/stores/detail/–/toys/B0000 . . . /107–5785330–610454, PP. 1–3 [accessed Mar. 27, 2001].

Dance Maker by Moose Mountain Toymakers, Ltd. http://ww.amazon.com/exec/obidos/ASIN/B00004YSZ3/0/qid=9 . . . /107–5785330–610454, pp. 1–3 http://mages.amazon-.com/images/P/B00004YSZ3.01.LZZZZZZZ.jpg, pp. 1 [accessed Mar. 27, 2001].

Game Show: Wheel of Fortune by Hasbro http://ww.amazon.com/exec/obidos/ASIN/B00000JPU4/qid=985 . . . /107–5785330–610454, pp. 1–4 [accessed Mar. 27, 2001].

Standard Scrabble by Milton Bradley http://ww.amazon-.com/exec/obidos/ASIN/B00000IWDB/o/qid=9 . . . /107–5785330–610454, pp. 1–4 [accessed Mar. 27, 2001].

Twister by Milton Bradley http://ww.amazon.com/exec/obidos/ASIN/B00000DMBK/qid=98 . . . /107–5785330–610454, pp. 1–4 http://mages.amazon.com/images/P/B00000DMBK.01.LZZZZZZZ.jpg, pp. 1 [accessed Mar. 27, 2001].

U.S. application No. 09/001,739, Forrest et al., filed Dec. 31, 1997.

* cited by examiner

*Primary Examiner*—Valencia Martin-Wallace
*Assistant Examiner*—Kathleen M. Christman
(74) *Attorney, Agent, or Firm*—Perkins Coie LLP

(57) ABSTRACT

A game device includes a plurality of user-selectable cells extending between start and finish areas, where each of the cells is associated with a character performing an answer to a question or clue that may be provided in the form of a category. One or more participants move from the start to the finish area by selecting cells whose characters when taken in order form a valid answer. A number of valid answers or paths between the start and finish areas can exist. The participant is scored at least in part based on the characters forming the valid answer.

54 Claims, 6 Drawing Sheets

INTERACTIVE QUIZ GAME SYSTEM AND METHOD

TECHNICAL FIELD

The present invention relates to the field of interactive entertainment systems and methods for using such systems by at least one player.

BACKGROUND OF THE INVENTION

A large variety of games exists for entertainment and educational purposes. Some games involve the movement of a participant about a game area, for example hopscotch and the game sold under the trademark TWISTER. Other games require the spelling of words. For example, well-known games such as crossword puzzles require the participant to spell out the answer to a question or clue in a letter-by-letter fashion. The well-known game called "hangman" and the game produced under the trademark WHEEL OF FORTUNE require the participant to guess letters to fill in blanks, and to eventually make an answer attempt at a partially completed word or phrase. The well-known game sold under the trademark SCRABBLE takes a slightly different approach, providing the participant with a set of characters from which the participant forms words without consideration to any clue or question. In SCRABBLE, at least one letter of the participant's answer must make contact with at least one letter of a word already existing on the game board. The participant attempts to achieve a high score by incorporating letters that have relatively high point values, where the point values are assigned based on their frequency of use in the language of the game (e.g. English, Spanish, French). Another commonly known game is sold under the trademark BOGGLE. In BOGGLE, a number of cubes or die bearing letters are shaken in a container and randomly fall into a grid. The participant must then identify as many words as possible, where the words are formed by contiguous pairs of letters. Further, a large number of computer-based programs exists for teaching spelling, general knowledge, and trivia. While many of these games can be informative and entertaining, they lack the excitement associated with physical movement of the participant through a maze or game board.

SUMMARY OF THE INVENTION

Under one aspect of the invention, a game device includes a plurality of user-selectable cells extending between start and finish areas, where each of the cells is associated with a character for forming an answer to a question or clue that may be provided in the form of a category. One or more participants move from the start to the finish area by selecting cells where the characters associated with the cells form a valid answer when taken in order. A number of valid answers or paths between the start and finish areas can exist. The participant is scored at least in part based on the characters forming the valid answer.

BRIEF DESCRIPTION OF THE DRAWINGS

In the drawings, identical reference numbers identify similar elements or acts. The sizes and relative positions of elements in the drawings are not necessarily drawn to scale. For example, lateral sizes and thicknesses are not drawn to scale, and are arbitrarily enlarged and positioned to improve drawing legibility.

DETAILED DESCRIPTION OF THE INVENTION

In the following description, certain specific details are set forth in order to provide a thorough understanding of various embodiments of the invention. However, one skilled in the art will understand that the invention may be practiced without these details. In other instances, well-known structures associated with user-selectable switches, programmed computers and displays have not been shown or described in detail to avoid unnecessarily obscuring descriptions of the embodiments of the invention.

An electronic interactive game system will first be discussed, including a description of an electronic game cell suitable for such a game system. A manual interactive came structure will then be discussed, followed by a discussion of a computer-based interactive game system. Of course, other embodiments are possible. The headings provided herein are for convenience only and do not interpret the scope or meaning of the claimed invention.

ELECTRONIC INTERACTIVE GAME SYSTEM

Figure 1:
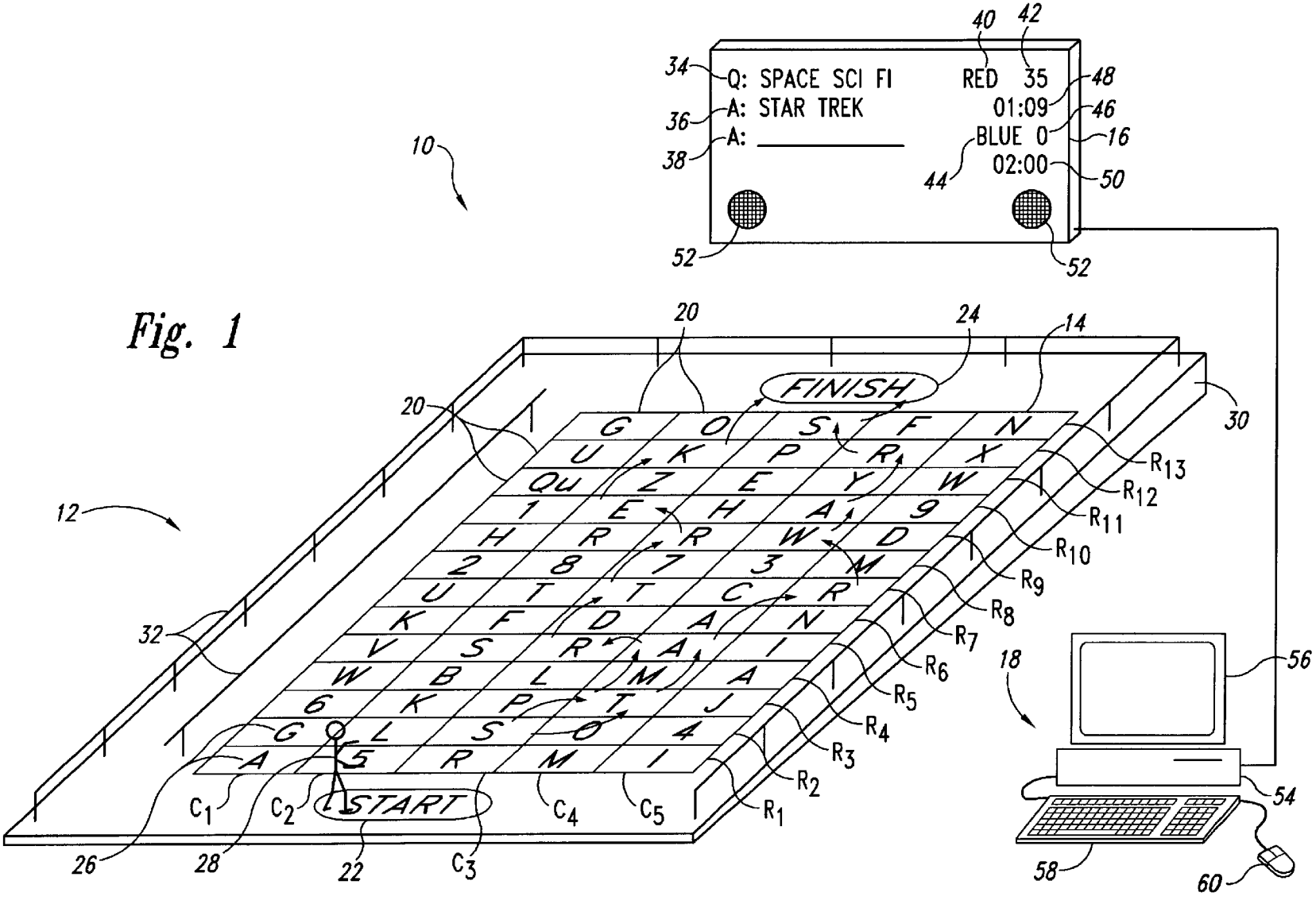
FIG. 1 is an isometric view of an integrated electronic game structure including a grid, a controller, and a display.

FIG. 1 shows an interactive integrated electronic game system 10 in an interactive game area 12 including a game grid 14, a game display 16, and an electronic controller in the form of a programmed general purpose computer system 18. The game grid 14 includes a number of user-selectable cells 20 extending between a start area 22 and a finish area 24. (Only four of the cells 20 are enumerated in FIG. 1 to improve drawing legibility.) Each cell 20 has a unique address corresponding to the row number $R_1$–$R_{13}$ and column number $C_1$–$C_5$, (e.g., $R_2$, $C_3$ corresponds to the cell containing the character "S" that is two cells from the left and one cell from the bottom of the game grid 14). Each cell 20 is a switch that produces a unique code or signal for the computer, in a manner similar to a keyboard. While FIG. 1 shows the cells 20 arranged in a rectangular grid of rows $R_1$–$R_{13}$ and columns $C_1$–$C_5$, other arrangements are possible. For example, the cells 20 of the grid 14 can be arranged in other shapes and are not required to form a contiguous pattern. The grid 14 can include a greater or smaller number of cells 20.

Each of the cells is associated with a character (e.g., letter, number, icon, or other human recognizable symbol). The cells 20 display the characters 26 so that a participant 28 can visually associate characters 26 and their respective cells 20. For example, the letter "A" is associated with the cell $R_1C_1$ such that activation of the cell $R_1C_1$ by the participant 28 selects the letter "A." The participant 28 may select a desired character 26 by stepping onto the cell 20 displaying the desired character 26. A ramp 30 carries the grid 14 such that the finish 24 is relatively higher than the start 22. This provides the participant 28 and spectators (not shown) a better view of the grid 14. The ramp 30 may include suitable handrails 32 to prevent the participant 28 from falling from the ramp 30. The participant 28 can also rely on the handrails 32 to maintain balance while moving from cell to cell 20. The ramp 30 and/or handrails 32 can be omitted from some embodiments. In an alternative embodiment, some of the cells 20 may not be associated with a character 26, the cell 20 serving as a blank, similar to a "blackened" space in a crossword puzzle. Additionally, or alternatively, the cell 20 can function as a "wild card" character 26, permitting the participant 28 to decide what character 26 the cell 20 will represent, for example by announcing the desired character 26 to a game operator.

The game display 16 is located in the interactive game area 12 for ease of view by the participant 28 and spectators (not shown). The game display 16 may take the form of a projection display, a liquid crystal diode ("LCD") display, a cathode ray tube ("CRT") display, or any other displays adaptable to electronic control. The game display 16 displays a question 34 which can take the form of an interrogatory, clue, or category for which the participant 28 must form an answer. The game display 16 displays previously selected correct answers 36 and a current answer 38 as the participant 28 forms the current answer 38 through the selection of cells 20. For example, a question 34 in the form of a category entitled Science Fiction Movies may have received an earlier valid answer 36 "Star Trek." The cells $R_2C_3$, $R_3C_4$, $R_5C_4$, $R_5C_3$, $R_7C_3$, $R_9C_3$, $R_{10}C_2$, $R_{12}C_2$ taken in order (as shown by the arrows extending between the cells) form the valid answer "Star Trek." The cells $R_2C_3$, $R_3C_4$, $R_5C_4$, $R_5C_3$, $R_7C_3$, $R_9C_3$, $R_{10}C_2$, $R_{12}C_2$ thus form a valid path between the start 22 and the finish 24. Another valid path for the question 34 is formed from the cells $R_2C_3$, $R_3C_4$, $R_5C_4$, $R_7C_5$, $R_9C_4$, $R_{10}C_4$, $R_{12}C_4$, and $R_{13}C_3$, that spell "Star Wars" when taken in order. The game display 16 can display an identifier or name 40 and score 42 of a first participant (not shown) and the identifier or name 44 and score 46 of a second participant 28. The display 16 can further include a chess clock providing a stop time 48, 50 for the first and second participants, respectively. The game display 16 can further include speakers 52 for producing audio questions, music, and sound effects for providing a more stimulating game environment.

As is generally known, the general purpose computer system 18 includes a game computer 54, an operator display 56, an operator keyboard 58, and other input devices such as a mouse 60. The operator display 56 can be a touch-sensitive display to allow an operator to control the interactive electronic game structure 10 by directly selecting icons displayed on the operator display 56. The operator (not shown) can use the operator keyboard 58 and mouse 60 for Generally controlling the game during play, or for configuring, the flame prior to play. For example, the operator can define questions such as categories, and define valid answers or paths prior to game play. During game play, the operator can use the touch-sensitive operator display 56 to select predefined answers and categories, and to override certain functions such as automatic scoring and automatic timing. The operator can also employ the touch-sensitive operator display 56 to select a particular game mode as described in detail below. The interactive operator display 56 further allows the operator to award or subtract points and/or time at the operator's discretion. The general purpose computer system 18 can permit the operator to reconfigure the grid 14, by redefining the association between various letters 26 and cells 20 and by causing the cells 20 to display the appropriate letters 26. The game computer 54 can employ a look-up table to related codes from the switches and the assigned characters 26 (e.g., alphanumeric values).

ELECTRONIC GAME CELL

Figure 2:
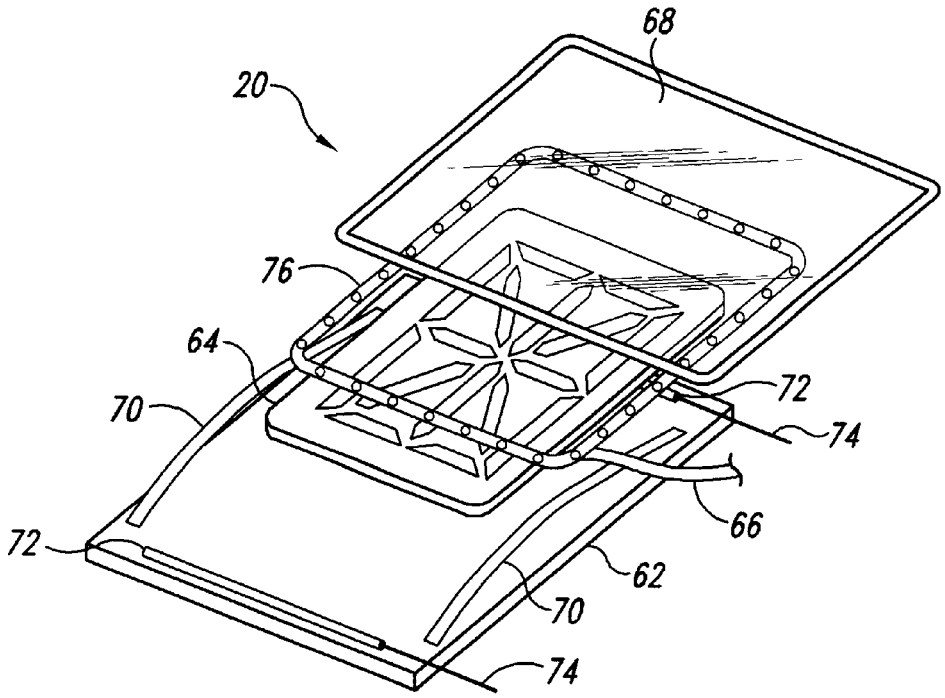
FIG. 2 is an exploded isometric view of a cell of the grid of FIG. 1.
Figure 7:
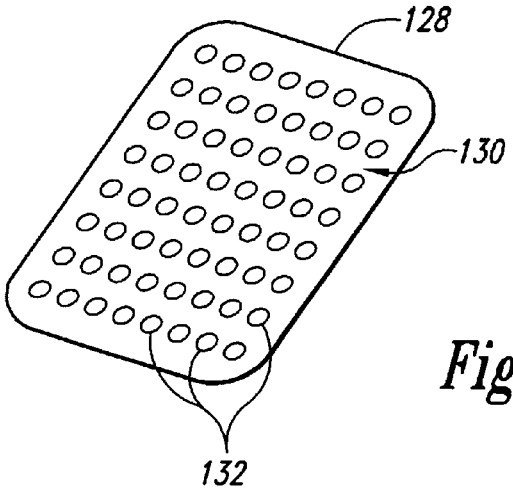
FIG. 7 is an isometric view of an LED display including a matrix of dot shaped light emitters.

FIG. 2 shows the components of one of the cells 20. The cell 20 includes a rigid backing 62 capable of supporting the participant 28 as the participant moves about the grid 14. The participant's movements can include running and jumping so a relatively strong material such as plywood flooring may be suitable. The backing 62 supports a display element, such as multi-element LED 64 that is selectively configurable by the game computer 54 to display desired characters 26. The multi-element LED 64 includes a control line 66 extending to the general purpose computer system 18. While the multi-element LED 64 shown in FIG. 2 is a common electronic device having 16 distinct linear elements, other arrangements may be suitable. For example, the multi-element LED 128 shown in FIG. 7 can form a matrix of distinct elements, for example a matrix 130 of 64 or 128 dot shaped light emitters 132 (only three are denominated for drawing legibility). Such a multi-element LED 132 may provide better resolution than the 16 element LED 64. A portion of the multi-element LED 132, such as an outer boarder of dot shaped light emitters 132 can provide a visual indication corresponding to certain actions, such as the selection of the cell 20, or the entry of a correct or incorrect answer. Other arrangements of display elements are of course possible.

A protective covering, such as a plexiglass panel 68 overlies the multi-segment LED 64 and the backing 62. The plexiglass panel 68 should be sufficiently clear to allow the participant 28 to view the character 26 formed by the multi-segment LED 64. A biasing member, such as pair of leaf springs 70 bias the plexiglass panel 68 from the backing 62. A pair of pressure sensitive contact switches 72 are engaged by the plexiglass panel 68 as the leaf springs 70 deform under the weight of the participant 28 stepping on the plexiglass panel 68. Engagement by the panel 68 closes at least one of the pressure sensitive switches 72, sending a signal alone switch signal line 74 to the game computer 54. Thus, the game computer 54 can control the multi-segment LED 64 to display a desired character 26, and can determine when the character 26 has been selected by the participant 28. In an alternative embodiment, the pressure-sensitive switches 72 can be configured to support the weight of the plexiglass panel 68 without activating until additional force is applied, thereby avoiding the need for springs 70.

The cell 20 can further include a visual cell indicator such as a series of color LEDs 76. The set of color LEDs 76 can include LEDs of different colors, for example red and yellow LEDs. The yellow LEDs may be activated in the cells 20 that have yet to be selected by the participant 28, while the red LEDs are activated on cells 20 that have already been selected by the participant 28. Additionally, the LEDs 76 can be activated to provide an indication of a successful answer attempt, for example by marqueeing, the LEDs in a clockwise or counterclockwise fashion about the selected cells 20. Such LED sets 76 are often available in a clear flexible tubing making the LEDs 76 easy to work with and providing some mechanical protection.

While the embodiment of FIG. 2 shows the cells 20 having an electronically configurable character display (multi-segment LED 64), the interactive game system 10 may employ simpler character display devices. For example, a stencil (e.g., a sheet having the outline of the character cut out) can be sandwiched between the backing 62 and the plexiglass panel 68. In such an embodiment, the stencil can be backlit by a light source such as an incandescent bulb or LED (not shown) to act as the character display. The rid 14 can be reconfigured by simply interchanging the stencils between the various cells 20 and updating the association between the cells 20 and the characters 26 in the game computer 54. The interactive game system 10 can employ other fixed or reconfigurable character displays. Alternatively, the characters 26 can be etched into the plexiglass panels 68 which can be held in place by clips or other fasteners that permit the characters 26 on the grid 14 to be manually rearranged.

MANUAL INTERACTIVE GAME STRUCTURE

Figure 3:
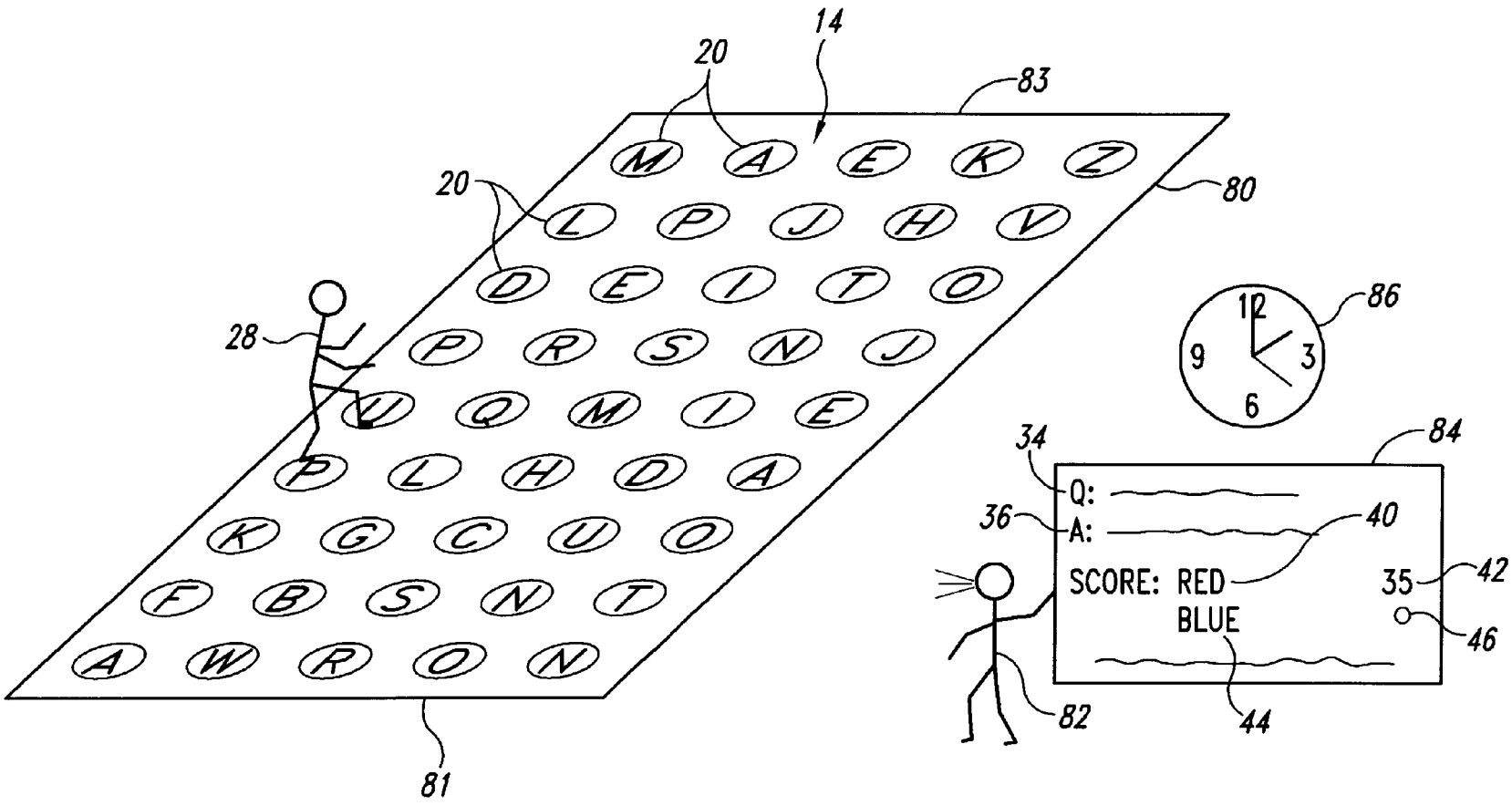
FIG. 3 is an isometric view of a manual game structure, including a grid formed on a flexible substrate, and a human game operator.

FIG. 3 shows an alternative embodiment in which the game grid 14 is formed on a flexible sheet 80. This alternative embodiment, and those alternative embodiments and other alternatives described herein, are substantially similar to previously embodiments, and common acts and structures are identified by the same reference numbers. Only significant differences in operation and structure are described in detail below.

The game structure 10 of FIG. 3 has the advantage of being inexpensive to construct and highly portable since the flexible sheet 80 can be rolled or folded for easy transport and storage. The cells 20 containing the letters 26 are distributed about the grid 14 and rows and columns, similar to the embodiment of FIG. 1. Other arrangements of the cells 20 are of course possible. A start area is defined at a first end 81 and a finish area at a second end 83 of the flexible mat 80. The participant 28 can respond to vocal commands, questions or queries issued by a human operator 82. The human operator 82 can visually monitor the participant 28, to determine the order and characters 26 selected by the participant 28 in response to the query. The operator 82 can write the question or query on a board such as a whiteboard or blackboard 84 to provide a visual indication of the question to the participant 28. The operator 82 can also monitor a clock 86 for timing the participant 28. The operator 82 can record the scores 42, 46 on the white or blackboard 84. The characters 26 are printed directly onto the flexible sheet 80.

In an alternative embodiment, the operator 82 can interact with a computer similar to the computer system 18 (FIG. 1), to manually input the participant's character selections. The operator 82 can read the queries, time, scores and other information from the game computer display 56.

Figure 4:
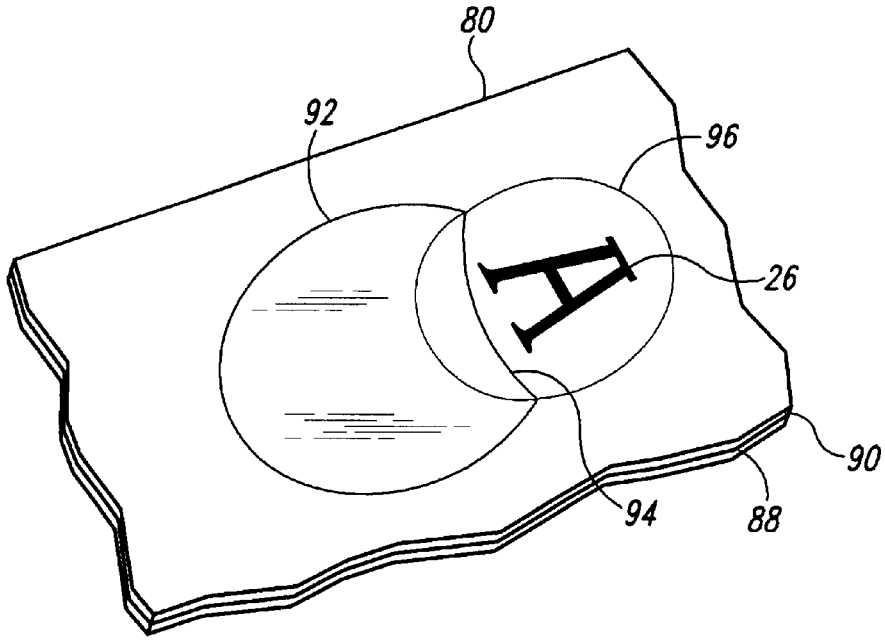
FIG. 4 is an isometric view of a cell of the grid of FIG. 3 including an interchangeable character.

In an alternative embodiment shown in FIG. 4, the flexible sheet 80 is formed by a backing sheet 88 and a transparent cover sheet 90. Pockets 92 are formed between the backing sheet 88 and the cover sheet 90. The pockets 92 have an opening 94 to allow the insertion and removal of a card 96 carrying the character 26. Thus the layout of characters 26 on the grid 14 can be easily modified without significantly increasing the cost of the game 10. The cover sheet 90 is transparent or semi-transparent such that the character 26 is clearly visible.

COMPUTER-BASED INTERACTIVE GAME SYSTEM

Figure 5:
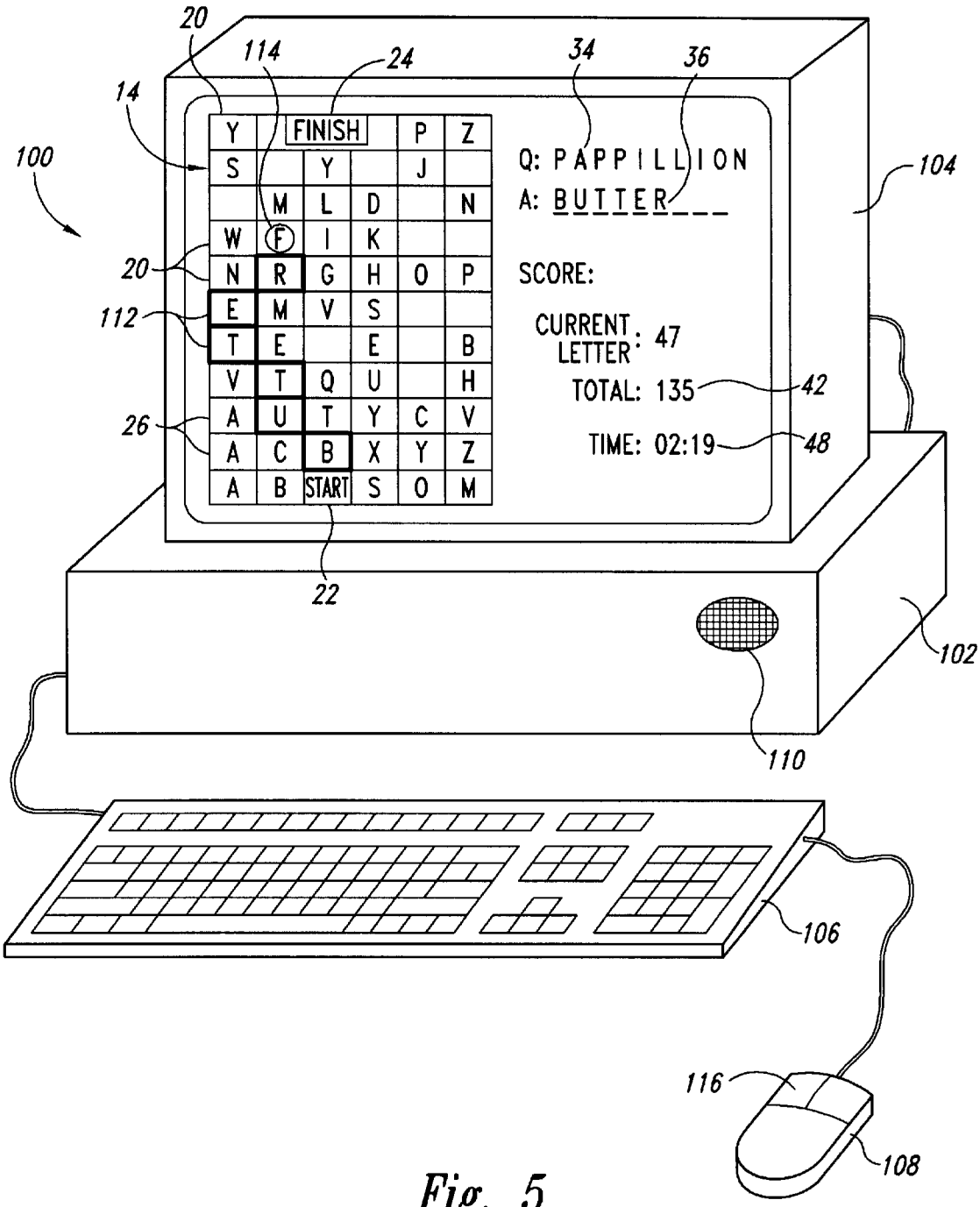
FIG. 5 is a computer implemented game structure including a grid formed as a display on a display monitor.

FIG. 5 shows a participant's computer system 100 including a computer 102, a computer display 104, a keyboard 106, and other input device such as a mouse 108. The computer display 104 displays the game grid 14 including the cells 20 and characters 26. The computer display 104 also displays the start and finish areas 22, 24, that can be part of the rid 14 or can be separate from the grid 14. Questions 34 can be displayed on the computer display 104 and/or provided through a speaker 110.

The computer display 104 can also display answers 38, as well as the score 42, and remaining time 48 if the game mode is timed. Selected characters 20 can be highlighted, as shown by the darkened borders of cells such as the cells 112. The participant 28 can select the desired cells 20 by moving the mouse 108 to position a cursor 114 over the desired cell 20 and clicking a mouse button 116 to select the cell 20. One skilled in the art will recognize other methods of selecting the desired cells 20. The software defining the game can reside in a computer-readable memory in the computer 102, such as a hard disk, CD-ROM, or floppy disk, or can reside in a server (e.g., distant computer) (not shown). Where the software resides on a server, the appropriate data can be relayed over a network such as the Internet or World Wide Web.

INTERACTIVE GAMING METHOD

Figure 6A:
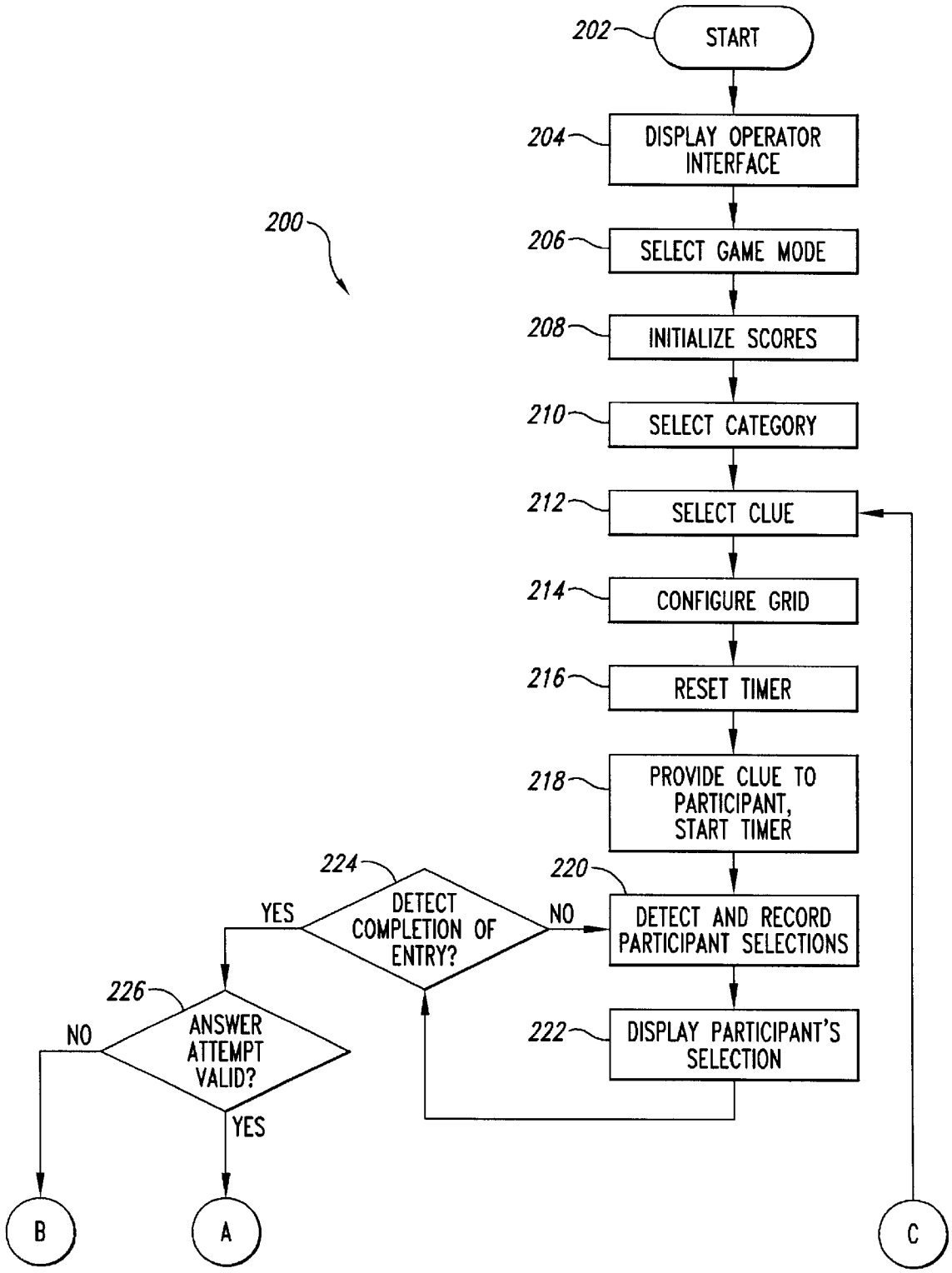
FIGS. 6A and 6B is a flowchart of acts for operating the game.
Figure 6B:
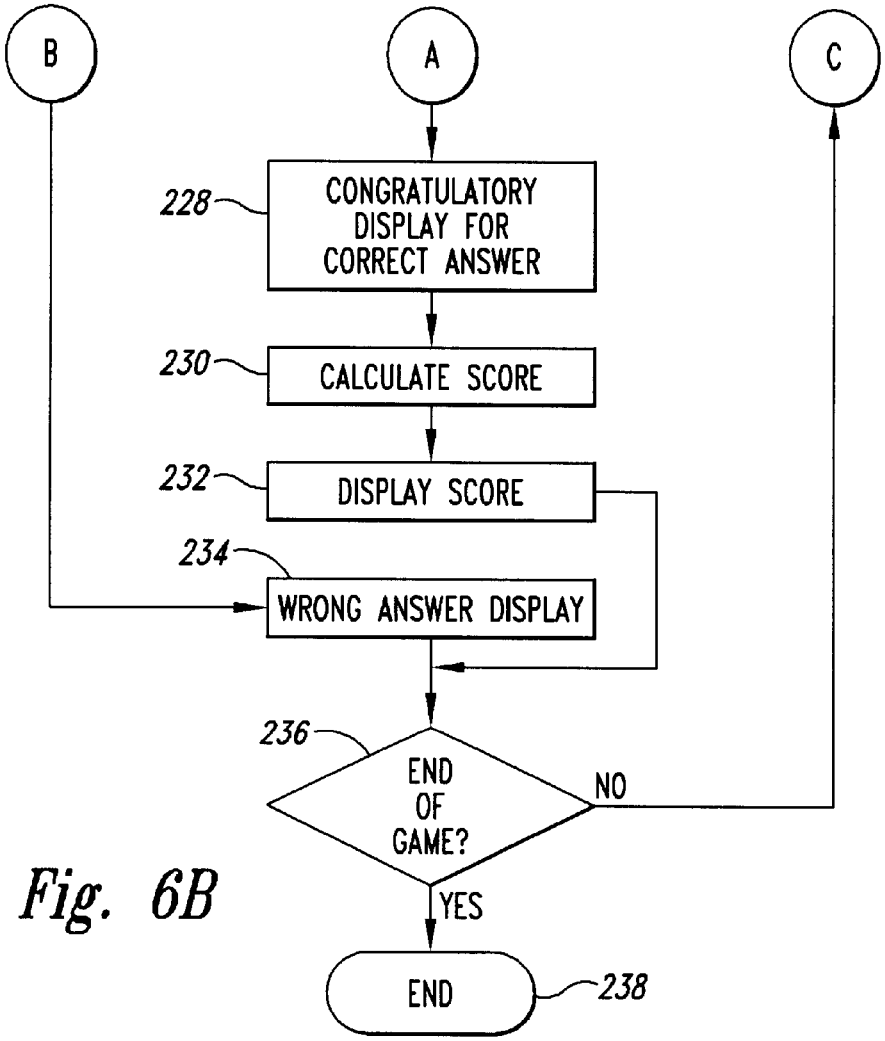

FIGS. 6A and 6B show a method 200 for operating the interactive game 10. As described, the method 200 includes some optional steps that can be used in operating the game 10. While the method will generally be discussed with reference to the embodiment of FIG. 1, the method is generally applicable to other embodiments, for example, the embodiments of FIGS. 3 and 5.

In step 202, the (game computer 54 starts up the game, for example initializing variables and loading instructions and data. The game computer 54 can start in response to an operator entry by way of the operator keyboard 58, mouse 60 or turning on of the game computer 54. In step 204, the game computer 54 displays an operator interface to the game computer display 56. The operator interface can cooperate with the touch-sensitive operator display 56 to allow the operator to quickly and easily configure and run the game. In step 206, the operator selects a game mode, for example selecting between a variety of game formats, as will be explained below. In step 208, the game computer 54 initializes the scores 42, 46.

In step 210, the game computer 54 automatically selects a category from a set of predefined categories. The selection can be random, and the game computer 54 can be programmed such that the same category will not be repeated during a game. The sets of predefined categories can be arranged in groups, where all categories in the group are related, for example, by subject matter. A large number of groups of categories permits the game to be tailored to the interest of the particular participants 28. This permits the operator to select an appropriate group of categories displayed on the operator display based on the common interest of the participants 28, such as industry related trivia at a party for employees of a business.

For example, a generic group may include the following categories and some acceptable answers:

CANDY BARS: ("MILKY WAY," "TWIX," "PAYDAY")

SHAKESPEARE PLAYS: ("HAMLET," "MACBETH," "ALLS WELL")

Examples of industry specific groups can include:

ATTORNEYS:

FAMOUS CASES: ("ROE V. WADE," "BROWN V. BOARD. OF ED.")

LATIN PHRASES: ("RES IPSA," "PRO SE," "IN REM")

SOFTWARE INDUSTRY:

LANGUAGES: ("COBOL," "BASIC," "PASCAL," "FORTRAN")

SEATTLE: ("MICROSOFT," "REAL NETWORKS," "VISIO")

In step 212, the game computer 54 selects a question or clue 34. In step 214, the same computer 54 configures the grid 14 by associating various characters 26 with cells 20 to provide a number of valid paths between the start 22 and finish 24. While step 214 is shown following steps 210 and 212, step 214 can be executed before or between these steps.

In such a situation, the existence of valid paths between the start 22 and finish 24 positions is a function of the distribution of the characters 26 throughout the grid 14, and the relative frequency of the characters 26 use in the language in which the game is played (e.g., English, Spanish, French). In this respect, the method 200 can include an additional step (not shown) permitting the operator to select an appropriate language.

In step 216, if the selected game mode employs one or more timers, the game computer 54 resets the timers 48, 50. In step 218, the came computer provides a clue or question to the participant 28 and starts the appropriate timer 46, 50. The game display 16 can visually provide the clue 34 to the participant 28, and/or the speakers 52 can provide the clue aurally.

In step 220, game computer 54 monitors the various cells 14, to detect selection of the cells 20 by the participant 28. Upon selection, the game computer 54 displays the participant's selection in step 222. For example, the game computer 54 may cause lights 76 (FIG. 2) of the particular cell 20 selected by the participant 28 to light up, change color, flash, or otherwise indicate selection. Additionally, or alternatively, the game computer 54 can cause the selection to be displayed on the game display 16. Other indications, for example an audible announcement, can be provided through the speakers 52. The game computer 54 continues detecting and displaying the participant's selections 220, 222 until the game computer 54 detects the completion of the answer entry in step 224. Completion can, for example, be sensed using a pressure-sensitive switch located at the finish 24. Upon detection of the completion, game computer 54 validates the answer attempt in step 226. Game computer 54 can compare the answer to a predefined list of acceptable answers, and additionally can check the spelling of the answer. The game computer 54 can permit the operator to override a determination that an answer attempt is incorrect. In such a case, the game computer 54 can temporarily update the list of acceptable answers for the duration of the game, or can permanently update the database of answers.

If the answer attempt in step 226 is not valid, control passes to step 234 where the game computer 54 produces an indication that the answer 36, 38 is incorrect, for example displaying a message to the game display 16, or controlling the sets of LEDs 76 (FIG. 2) of the cells 20 to present some particular predefined pattern.

If the game computer 54 determines that the answer attempt is valid in step 226, the game computer 54 passes control to step 288, producing a congratulatory display for achieving a correct answer. Again, the game computer 54 can provide the indication such as a visual display on the game display 16, an audio indication such as festive music played through the speakers 52, and/or a visual indication through lights associated with the cells 20 such as the LEDs 76. In step 230, the game computer 54 calculates a score for the participant 28. The game computer 54 can be programmed to include a number of different game modes that may include different methods of scoring. For example, the score can be based on letter values which are assigned to the characters 20 based on the frequency of the character's appearance in the language. The score can be based on the total number of characters 20 in the answer attempt, for example awarding a single point for each character in the answer attempt. Additionally, or alternatively, the score can be based on the value assigned to each valid answer based on the obscurity of the answer. Other methods of scoring would of course be possible.

In step 232, the game computer 54 causes the game display 16 to display the score 42, 46. After displaying the score in step 232 or providing a wrong answer display in step 234, the game computer 54 determines whether the game is at an end in step 236. The condition associated with the end of a game may be different in different game modes. For example, the game may be at an end when the total time for any single participant 28 has expired, or alternatively only when the total time for each participant 28 has expired. Additionally, or alternatively, the came may end only after a set number of clues have been provided and/or a set number of categories have been provided.

A single participant 28 can play the game, for example attempting to spell as many valid answers as possible in a given time, or to score as many points as possible, based on character or word values in valid answer attempts, in the given time. In one game mode, the interactive game system 10 can require that a last selected cell 20 remain activated while a next selective cell is activated, thus requiring the participant 28 to step from cell to cell. In another game mode, the interactive game system 10 can require that only a single cell 20 is activated at a given time, thus requiring the participant 28 to jump or leap from cell to cell (e.g., both feet must leave the board at the same time prior to activating a next cell 20).

Participants 28 can also play against each other. For example, each participant 28 can be given an amount of time to spell as many answers as possible. Participants 28 can alternate turns until one or more of their allotted times runs out. Teams of participants 28 can play together, for example taking alternative turns at answering respective questions. Teams of participants 28 can also play together by taking alternative turns at selecting characters 26 to spell out a single answer attempt to a question or clue. During team play, the interactive game system 10 can require that at last cell 20 remain activated while a next cell 20 is selected, thus ensuring that the team members 28 alternative turns. The interactive came system thus provides a fun, entertaining and educational game environment.

U.S. Pat. No. 5,679,075, issued Oct. 21, 1997 from application Ser. No. 08/554,578, filed Nov. 6, 1995, entitled "INTERACTIVE MULTI-MEDIA GAME SYSTEM AND METHOD" and U.S. patent application Ser. No. 09/001,739, filed Dec. 31, 1997, entitled "ELECTRONICALLY INTERACTIVE LOCATION BASED MULTIMEDIA GAME SYSTEM AND METHOD" each disclose other structures and methods of providing a fun, entertaining and educational game environment.

The various embodiments described above can be combined to provide further embodiments. All of the above U.S. patents, patent applications and publications referred to in the specification are incorporated by reference. Other alternative embodiments are possible by combining the embodiments taught herein with those taught in the incorporated patents and patent applications. Aspects of the invention can be modified, if necessary, to employ systems, circuits and concepts of the various patents, applications and publications to provide yet further embodiments of the invention.

These and other changes can be made to the invention in light of the above detailed description. In general, in the following claims, the terms used should not be construed to limit the invention to specific embodiments disclosed in the specification and the claims, but should be construed to include all interactive names and systems that operate in accordance with the claims. Accordingly, the invention is not limited by the disclosure, but instead its scope is to be determined entirely by the following claims.

We claim:

1. A foot activated game, comprising a grid having a plurality of foot-activated switching cells, each of the foot-activated switching cells associable with one of a number of characters such that activation the foot-activated switching cell selects the associated character, at least a first one of the foot-activated switching cells spaced form at least second one of the foot-activated cells such that a participant cannot step from the first foot-activated switching cell to the second foot-activated switching cell; and an electronic controller coupled to detect activation of the foot-activated switching cells.

2. The apparatus of claim 1, further comprising:

a start position; and a finish position opposed to the start position where the cells are between the start position and the finish position.

3. The apparatus of claim 1, further comprising:

a character display physically associated with each of the foot-activated switching cells, each of the character displays coupled to the electronic controller for controlling the association of the characters with the foot-activated switching cells.

4. The apparatus of claim 1 wherein at least a first one of the foot-activated switching cells is adjacent at least a second one of the foot-activated switching cells.

5. The apparatus of claim 1 wherein at least a first one of the foot-activated switching is spaced from all of the other ones of the foot-activated switching cells.

6. The apparatus of claim 1 wherein grid comprises a floor structure.

7. A method of performing a game, comprising:

receiving a question;

determining an answer attempt in response to the question;

selecting a path from a start position to a finish position spaced apart from the start position, the path comprising a number of cells selected from a plurality of cells, the plurality of cells each associated with a character, the characters associated with each of the number of cells comprising the path forming the answer attempt; and receiving a score based at least partially on whether the answer attempt is correct.

8. The method of claim 7 wherein selecting a path from a start position to a finish position includes successively activating a number of switches, where each switch is associated with a respective one of the number of selected cells.

9. The method of claim 7 wherein the plurality of cells are foot pads and selecting a path from a start position to a finish position includes successively stepping on each of the foot pads corresponding to each of the number of selected cells to activated a respective one of a number of switches.

10. The method of claim 7 wherein the plurality of cells are foot pads and selecting a path from a start position to a finish position includes stepping on each of the foot pads corresponding to each of the number of selected cells to activated a respective one of a number of switches, such that only a single switch is activated at any single time.

11. A method of operating a game, comprising:

providing a question to a participant;

monitoring a grid extending between a start and finish positions and comprising a plurality of cells for a participant selection of a number of the cells in response to the question, where each of the cells is associated with a respective one of a plurality of characters, the characters associated with the number of the selected cells forming an answer attempt; and checking the validity of the answer attempt in response to a participant selection of the finish position and scoring the participant based on the answer attempt.

12. The method of claim 11 wherein providing a question to a participant includes displaying the question.

13. The method of claim 11 wherein providing a question to a participant includes operating an electronic display screen to display the question.

14. The method of claim 11 wherein providing a question to a participant includes producing sounds comprising the question.

15. The method of claim 11 wherein providing a question to a participant includes operating a speaker to produce the question.

16. The method of claim 11 wherein monitoring a grid includes visually determining the cells selected by the participant.

17. The method of claim 11 wherein monitoring a grid includes determining a state of a number of switches, the switches associated with respective ones of the cells.

18. The method of claim 11 wherein monitoring a grid includes determining a successive series of foot positions for the participant.

19. The method of claim 11 wherein monitoring a grid includes determining a successive series of finger positions for the participant.

20. The method of claim 11 wherein monitoring a grid includes determining a successive series of cursor positions for a cursor operated by the participant.

21. A method of operating a game, comprising:

providing one of several questions to a participant;

validating a path extending between a starting position and a predefined finishing position, the path comprising a number of cells selected by the participant from a plurality of cells, each of the number of cells associated with a respective character, the characters associated with the number of selected cells forming an answer attempt in response to the question; and determining a score at least partially based on a validity of the path.

22. The method of claim 21 wherein validating a path extending between a starting position and a predefined finishing position includes visually determining a successive series of foot positions with respect to the cells for the participant.

23. The method of claim 21 wherein validating a path extending between a starting position and a predefined finishing position includes automatically determining a successive series of foot positions with respect to the cells for the participant.

24. The method of claim 21 wherein validating a path extending between a starting position and a predefined finishing position includes automatically determining a successive series of finger positions with respect to the cells for the participant.

25. The method of claim 21 wherein validating a path extending between a starting position and a predefined finishing position includes determining a successive series of cursor positions for a cursor operated by the participant.

26. The method of claim 21 wherein validating a path extending between a starting position and a predefined finishing position includes comparing the answer attempt to at least one correct answer.

27. The method of claim 21 wherein validating a path extending between a starting position and a predefined finishing position includes determining if the answer attempt is a correctly spelled word.

28. The method of claim 21 wherein validating a path extending between a starting position and a predefined finishing position includes determining a spacing between each pair of successively selected cells, and comparing the spacing to a maximum spacing.

29. The method of claim 21 wherein validating a path extending between a starting position and a predefined finishing position includes determining that the cells in each pair of successively selected cells are adjacent one another.

30. The method of claim 21 wherein validating a path extending between a starting position and a predefined finishing position includes determining that the cells in each pair of successively selected cells are physically within a maximum number of cells of one another.

31. The method of claim 21 wherein validating a path extending between a starting position and a predefined finishing position includes comparing the number of characters forming the answer attempt to a predefined minimum number of characters.

32. The method of claim 21 wherein determining a score at least partially based on a validity of the path includes awarding points when the answer attempt matches a correct answer.

33. The method of claim 21 wherein determining a score at least partially based on a validity of the path includes awarding points when the answer attempt matches a correct answer within a time period.

34. The method of claim 21 wherein determining a score at least partially based on a validity of the path includes awarding points for each of the characters forming the answer attempt when the answer attempt matches a correct answer.

35. The method of claim 21 wherein determining a score at least partially based on a validity of the path includes awarding points based on a predefined difficulty for the answer attempt when the answer attempt matches a correct answer.

36. The method of claim 21 wherein determining a score at least partially based on a validity of the path includes awarding points for each answer attempt in a time period that matches one of a number of correct answers.

37. The method of claim 21, wherein the score is determined automatically, and further comprising:

overriding the automatically determined score.

38. The method of claim 21, further comprising:

storing a number of valid answers in a memory for validating the answer attempt.

39. The method of claim 21, further comprising:

storing of cell identifiers for each of a number of valid answers, the cell identifiers corresponding to each of the cells associated with a respective one of the characters forming the valid answer.

40. The method of claim 21, further comprising:

updating a list of valid answers with the answer attempt in response to a signal indicating that the answer attempt is valid.

41. A game apparatus, comprising:

an input device having a plurality of participant selectable cells between a start area and a finish area, each of the cells displaying a respective character;

a processor coupled to the input device to recognize the characters displayed by the cells as respective input values in response to a selection of the cells by a participant, the processor further configured to accept at least two valid paths between the start area and the finish area, each of the valid paths comprising at least three cells where the respective characters displayed by the at least three cells form a valid answer to a question provided to the participant;

a memory coupled to the processor and storing the valid paths; and a visual display device coupled to, and controlled by the processor, for displaying at least a score.

42. The apparatus of claim 41 wherein each of the cells includes at least one switch.

43. The apparatus of claim 41, further comprising:

a user configurable character display in each of the cells.

44. The apparatus of claim 41, further comprising:

a pocket formed in each of the cells sized and dimensioned to interchangeably receive media bearing character indicia.

45. The apparatus of claim 41, further comprising:

an electronic character display in each of the cells, the character display coupled to the processor to control the presentation of the respective character for the cell.

46. The apparatus of claim 41 wherein each of the cells includes at least one foot activated switch and at least one light source.

47. The apparatus of claim 41 wherein the finish area includes a participant selectable switch coupled to the processor to provide a signal indicating a completion of the selection of cells by the participant in response to the question.

48. The apparatus of claim 41 wherein the memory stores the valid answer for each of the valid paths.

49. A game apparatus, comprising:

a plurality of user selectable switches between a start area and a finish area, each of the switches having a character associated therewith, wherein at least one group of at least two of the switches forms a valid path extending between the start and the finish areas, the characters associated with each of the switches in the valid path forming a valid answer to a question when taken in an order matching an order of the switches appearing in the valid path.

50. The apparatus of claim 49 wherein the characters include at least one of alphabetic characters, numeric characters, and icons.

51. The apparatus of claim 49 wherein switches are foot activated switches arranged in a grid for being stepped on by the participant.

52. The apparatus of claim 49 wherein the switches are pressure sensitive switches.

53. The apparatus of claim 49 wherein the switches are proximity sensitive switches.

54. A computer readable medium whose contents cause a first computer system to perform a game, comprising:

providing a question to a participant;

monitoring a grid extending between start and finish positions and comprising a plurality of cells for a participant selection of a number of the cells in response to the question, where each of the cells is associated with a respective one of a plurality of characters the characters associated with the number of the selected cells forming an answer attempt; and checking the validity of the answer attempt in response to a participant selection of the finish position and scoring the participant based on the answer attempt.

* * * * *

UNITED STATES PATENT AND TRADEMARK OFFICE

CERTIFICATE OF CORRECTION

PATENT NO. : 6,322,074 B1
DATED : November 27, 2001
INVENTOR(S) : Andrew R. Forrest et al.

It is certified that error appears in the above-identified patent and that said Letters Patent is hereby corrected as shown below:

Column 2,
Line 29, "came" should be -- game --;

Column 3,
Line 50, "Generally" should be -- generally --;
Line 51, "configuring, the flame" should be -- configuring the game --;

Column 4,
Line 37, "alone" should be -- along --;
Line 53, delete the comma between "marqueeing" and "the";
Line 66, "rid" should be -- grid --;

Column 5,
Line 60, "rid" should be -- grid --;

Column 6,
Line 19, delete the parenthesis between "the" and "game", first occurrence;
Line 63, "same" should be -- game --;

Column 7,
Line 11, "came" should be -- game --;

Column 8,
Lines 10 and 38, "came" should be -- game --;
Line 64, "names" should be -- games --;

Column 9,
Line 2, add a colon after "comprising"; and

UNITED STATES PATENT AND TRADEMARK OFFICE

CERTIFICATE OF CORRECTION

PATENT NO. : 6,322,074 B1
DATED : November 27, 2001
INVENTOR(S) : Andrew R. Forrest et al.

It is certified that error appears in the above-identified patent and that said Letters Patent is hereby corrected as shown below:

Column 12,
Line 61, add a comma between "characters" and "the".

Signed and Sealed this

Eleventh Day of June, 2002

*Attest:*

*Attesting Officer*

JAMES E. ROGAN
*Director of the United States Patent and Trademark Office*